US005184436A

United States Patent [19]

Sadler

[11] Patent Number: 5,184,436

[45] Date of Patent: Feb. 9, 1993

[54] PORTABLE UTILITY STRUCTURE

[76] Inventor: Ted Sadler, 575 N. Main St., Imlay City, Mich. 48444

[21] Appl. No.: 789,996

[22] Filed: Nov. 12, 1991

[51] Int. Cl.[5] ..... B04H 6/02

[52] U.S. Cl. ..... 52/79.1; 446/478

[58] Field of Search ..... 52/71, 70, 90, 64, 69, 52/86, 79.1, 143, 79.5, 79.9; 446/478, 488

[56] References Cited

U.S. PATENT DOCUMENTS

| | | | |
|---|---|---|---|
| 2,047,721 | 7/1936 | Wilson | 52/90 |
| 2,670,986 | 3/1954 | Presnell | 52/71 |
| 3,363,360 | 1/1968 | Ryan | 446/478 |
| 3,656,256 | 4/1972 | Maskell et al. | 446/488 |
| 3,739,536 | 6/1973 | Ward | 52/90 |
| 4,115,967 | 9/1978 | Kragt | 52/90 |
| 4,467,572 | 8/1984 | Somers et al. | 52/94 |
| 4,523,418 | 6/1985 | McLaughlin | 52/284 |
| 4,633,626 | 1/1987 | Freeman et al. | 52/79.5 |
| 4,876,832 | 10/1989 | Wasserman | 52/79.1 |
| 4,964,249 | 10/1990 | Payne | 446/478 |

*Primary Examiner*—David A. Scherbel
*Assistant Examiner*—Michele A. Van Patten
*Attorney, Agent, or Firm*—Dykema Gossett

[57] ABSTRACT

A portable structure is disclosed that may be easily assembled and disassembled. The structure has particular value in supplying emergency shelter in a disaster. The structure is formed from two boards which are stored in a folded condition, and which may be expanded to define an enclosure. The two boards are interconnected by tabs, such that the structure is easily assembled and disassembled.

17 Claims, 3 Drawing Sheets

PORTABLE UTILITY STRUCTURE

BACKGROUND OF THE INVENTION

This invention relates to a portable structure designed to provide shelter in times of natural, mechanical or man-made disasters.

In times of calamity such as floods and hurricanes, traditional housing is often damaged or destroyed. Yet, in such situations shelter becomes even more of a necessity. It would be desirable to be able to store a large number of shelters in a relatively small space, such that they can be transported to a disaster site. Tents may provide a limited alternative, but are subject to several limitations. Tents may not store well over a long period of time, they may require expertise and special tooling is required for their assembly, and they are generally constructed of various components which are stored separately. Tents are also not designed for use over a prolonged period of time in unexpected, but adverse circumstances.

SUMMARY OF THE INVENTION

This invention relates to a portable utility structure, and a method for making the structure. The structure may be used in a variety of situations, and a large number of such structures may be easily stored and transported before and after each use.

The inventive structure is capable of assembly under adverse conditions with little or no instruction and expertise. Construction is quickly and easily accomplished, with no tools or implements which may be unavailable or misplaced being necessary.

When assembled, the portable utility structure is able to withstand and adapt to a wide range of environmental conditions. It is resistant to water, strong winds, and high temperatures. The portable utility structure is not effected by exposure to ultra-violet radiation from the sun. Further, the portable utility structure is constructed of environmentally safe elements, such that even if destroyed, its by-products will not add further complications.

The portable utility structure is not subject to a single use. It is easily dismantled and assembled, such that a structure is capable of storage and later reassembly. This is not only cost effective, but aids in protecting the environment. In a preferred embodiment, the portable utility structure is constructed of two interchangeable pieces, so that even if one element is damaged, it can be easily replaced. If two structures lose different elements, the remaining structural pieces are then re-usable and capable of being combined to construct a new shelter.

In a most preferred embodiment, the portable utility structure is constructed from two boards which are scored and cut, such that they may be folded into a storage position prior to assembly. Necessary hardware is attached before the boards are stored. One board consists of a bottom panel integrally hinged to two sidewalls. The sidewalls are preferably five sided, with one containing a door and the second, a window. The second board is compatibly dimensioned with respect to the first board. It consists of two lower roof panels, two upper roof panels, two sand flaps, and extension panels with tabs. To assemble the structure, the first board is placed on the ground and the sidewall panels folded upwardly relative to the bottom panel. The second board is folded to fill the gap defined by the sidewalls and bottom panel, and form an enclosed structure. Then the extension panels are folded over to seal the edges between the two boards, and the tabs associated with the extension panels are inserted into aligned apertures in the first board. The tabs are removed from the apertures when the house is to be dismantled and folded back into its storage configuration.

These and other features of the present invention will be best understood from the following specification and drawings.

DETAILED DESCRIPTION OF A DISCLOSED EMBODIMENT

Figure 1:
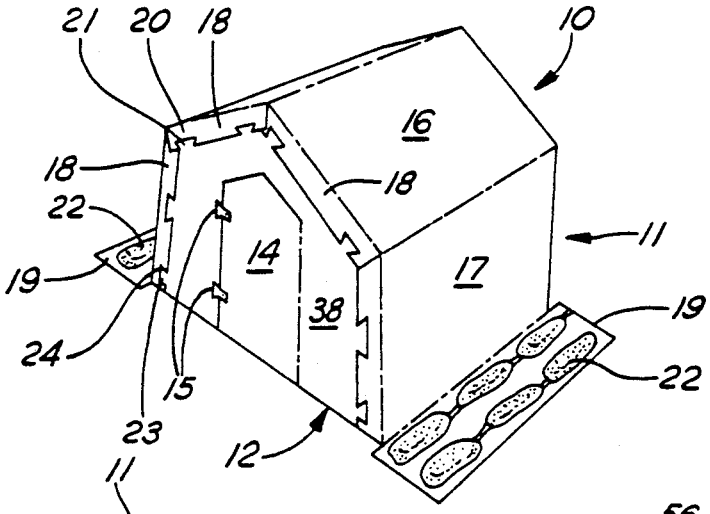
FIG. 1 is a perspective view of one embodiment of the present invention.

FIG. 1 is a perspective view of a portable utility structure 10. In this disclosed embodiment, the structure is constructed of two large corrugated, extruded polyethelene boards 11 and 12. Board 12 includes a front panel 38 which has a door 14 and two clasps 15. Board 11 consists of two upper roof panels 16, two lower roof panels 17, eight extension panels 18, and two sand flaps 19. Extension panels 18 are formed along two edges of each roof panel, and come into contact with panels formed in board 12. Each extension panel 18 has tabs 20 or 23 which are inserted into slots 21 or 24 in board 12. Extension panels 18 provide additional structural support as well as sealing the exposed edges of adjacent panels. The use of tabs 20 and 23 in conjunction with slots 21 and 24 allow the structure to be assembled and dismantled as required.

Figure 2:
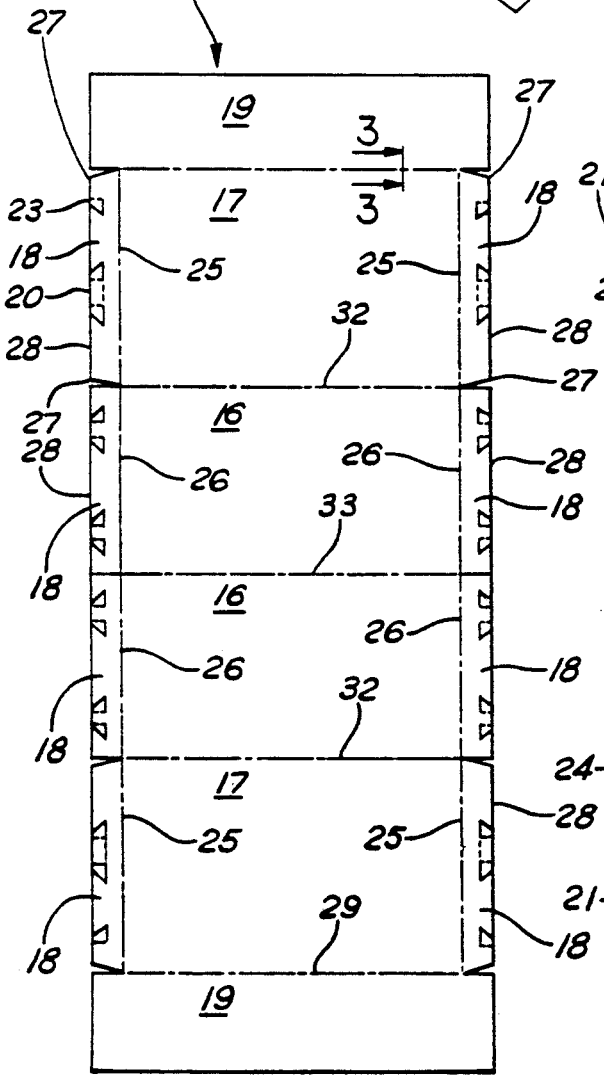
FIG. 2 is a top view of a first board for forming the inventive structure.

FIG. 2 shows board 11 in greater detail. Board 11 is constructed from a single sheet of corrugated, extruded polyethelene and has two sand flaps 19, two lower roof panels 17, and two upper roof panels 16. Extension panels 18 are formed along a lateral edge defined by score lines 25 on lower roof panels 17 and along lateral edges defined by score lines 26 on upper roof panels 16. Each extension panel 18 attached to an upper roof panel 16 has two tabs 20 along outer edges 28, and each extension panel 18 attached to a lower roof panel 17 has one tab 20 and a smaller tab 23 near sand flap 19. Extension panels 18 associated with lower roof panels 17 may be notched at ends 27 along outer edge 28 to aid in assembly when board 11 is folded.

Figure 3:
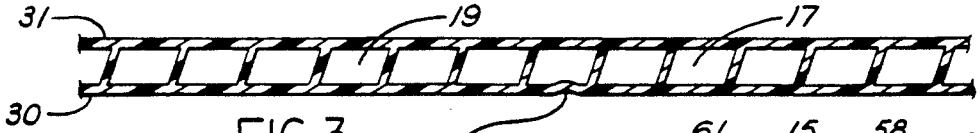
FIG. 3 is a cross-sectional view along line 3—3 as shown in FIG. 2.

FIG. 3 shows a cross-sectional view of board 11 along line 3—3 in FIG. 2. Because of score line 29 made on inner face 30 of board 11, an integral hinge is formed with motion limited such that sand flap 19 can only break the plane defined by outer face 31 of board 11. On the other hand, score lines 25, 26, 32, and 33, see FIG. 2, are on the outer face 31 of board 11, and each of the panels divided by these score lines have integral hinges which only break the plane defined by inner face 30 when folded.

Figure 4:
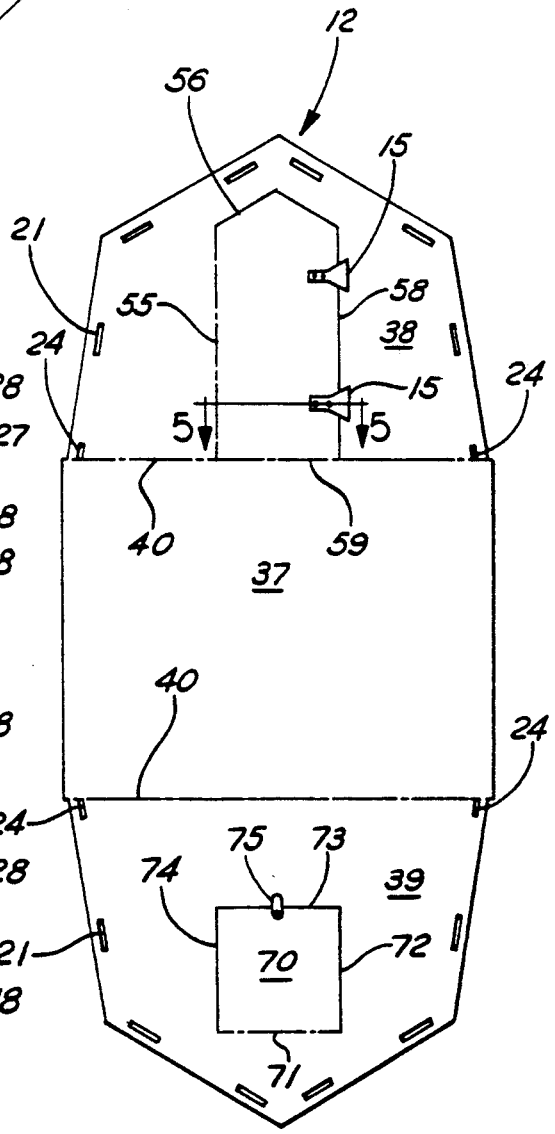
FIG. 4 is a top view of a second board.
Figure 5:
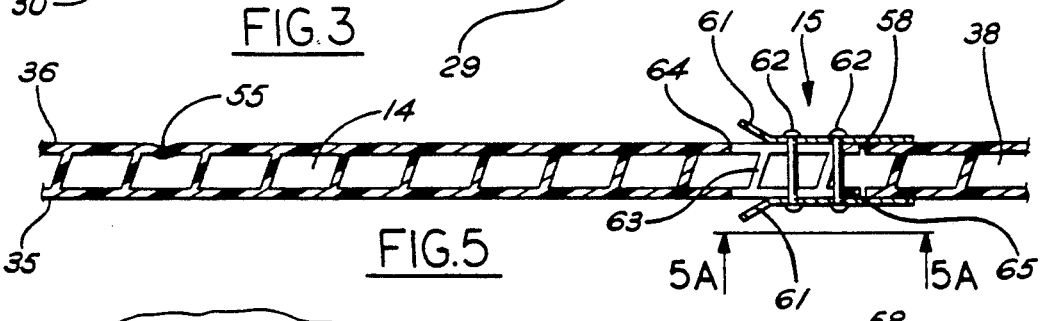
FIG. 5 is a cross-sectional view along lines 5—5 as shown in FIG. 3.

Referring now to FIGS. 4 and 5, FIG. 4 shows the inner face 35 of board 12 in greater detail. Constructed from a single sheet of corrugated, extruded polyethelene, board 12 consists of a bottom panel 37, a front panel 38, and a rear panel 39. Front panel 38 and rear panel 39 are defined and separated from bottom panel 37 by score lines 40, which are made on the outer face 36 of board 12. Both front panel 38 and rear panel 39 have slots 21 and 24 along those edges not in contact with bottom panel 41, and which are designed to receive tabs 20 and 23, respectively.

Figure 6:
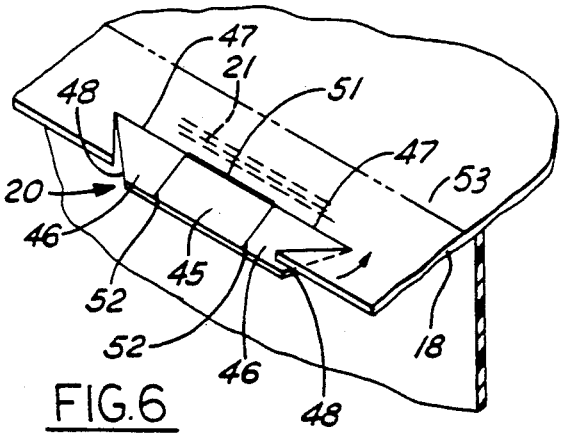
FIG. 6 is a perspective view showing structure for connecting the two boards of this invention.
Figure 7:
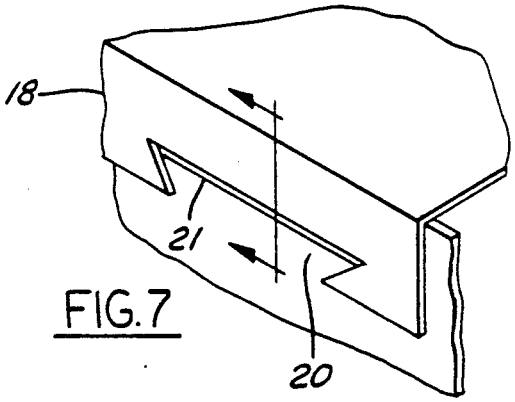
FIG. 7 is a perspective view of the structure shown in FIG. 6 after having been detachably secured.

The interaction of a tab 20 with a corresponding slot 21 is demonstrated in FIGS. 6 through 9. In FIG. 6, a center tab portion 45 is separated from two outer tab portions 46 by score lines 52. Center tab portion 45 is also integrally hinged with respect to a panel by score line 51 made on outer face 53 of extension panel 18 so that tab 20 will fold inwardly and fit into slot 21. Edges 47 and 48 are completely cut. In FIG. 7, tab 20 is shown completely inserted within slot 21.

Figure 8:
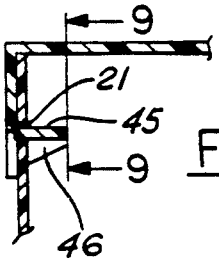
FIG. 8 is a cross-sectional view along line 8—8 as shown in FIG. 7.

FIG. 8 is a cross-sectional view along line 8—8 of FIG. 7, and shows tab 20 within slot 21. An outer tab portion 46 is shown turned down with respect to center tab portion 45.

Figure 9:
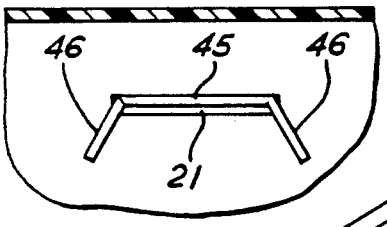
FIG. 9 is a back view along line 9—9 as shown in FIG. 7.

This is better illustrated in FIG. 9 where both outer tab portions 46 are shown turned down with respect to center tab portion 45. Further, in FIG. 9 it can be seen that slot 21 must be at least twice the thickness of board 11 since outer tab portions 46 come into contact with the underside of center tab portion 45 in order to fit in the slot. Then outer tab portions 46 are lowered so that the two panels are interconnected. In order to disengage tab 20 from slot 21, outer tab portions 46 are again brought into contact with the underside of center tab portion 45 and tab 20 is removed from slot 21.

Figure 5A:
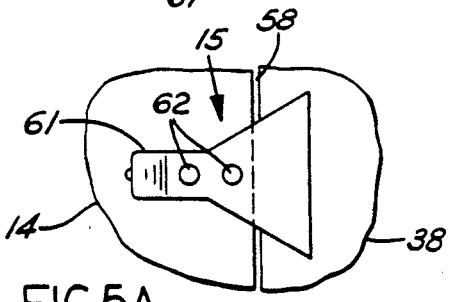
FIG. 5A is a detail side view of the area of FIG. 5 from the direction identified by line 5A—5A, showing the door structure.

As shown in FIG. 4 and FIGS. 5 and 5A, front panel 38 has a door 14 which is integrally hinged along the edge defined by score line 55. Although FIG. 5 shows score line 55 along the outer face 36 score line 55 may be along either the inner or outer face of board 12. Edges 56 through 59 are completely cut, with edge 58 shown completely separated from the front panel 38 in FIG. 5. Door 14 has two clasps 15. Clasp elements 61 are on both the inner face 35 and the outer face 36 of board 12. Two bolts 62 join the two clasp elements 61, and the bolts 62 ride in a channel 63, formed within door 14. When one of the bolts 62 contacts the outer edge 65 of channel 63, clasp 60 engages front panel 38. When one of the bolts 62 contacts the inner edge 64 of channel 63, clasp 60 is disengaged from front panel 38. When both clasps 15 are in this latter position, door 14 may be opened.

Figure 14:
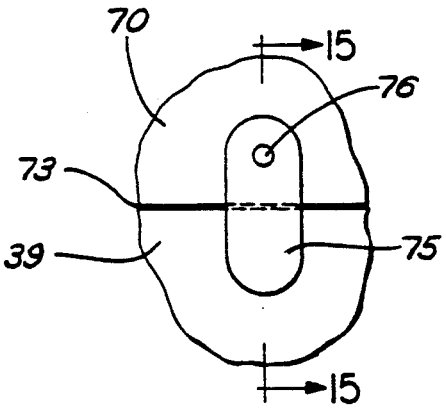
FIG. 14 is a detail front view of a window structure for use with the present invention.
Figure 15:
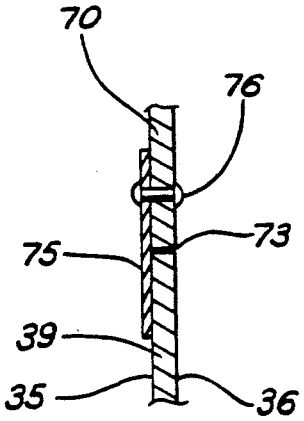
FIG. 15 is a cross-sectional view along line 15—15 as shown in FIG. 14.

Now looking at FIG. 4 in conjunction with FIGS. 14 and 15, rear panel 39 has a window 70 which is integrally hinged along the edge defined by score line 71. Score line 71 are made along the inner face 35 of board 12. Edges 72 through 74 is completely cut out from the polyethelene. Window 70 has a clasp 75 attached to window 70 by a bolt 76, and clasp 75 is found along the inner face 35 of board 12. When the clasp is rotated about the longitudinal axis defined by bolt 76, window 75 may be opened outwardly, breaking the plane defined by outer face 36 on board 12.

Figure 11:
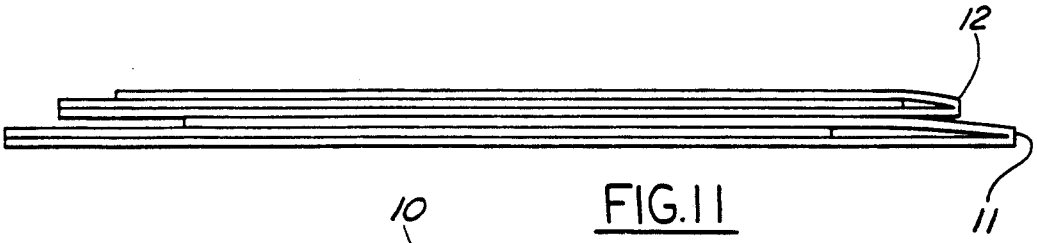
FIG. 11 is a side view identified by line 11 in FIG. 10.
Figure 10:
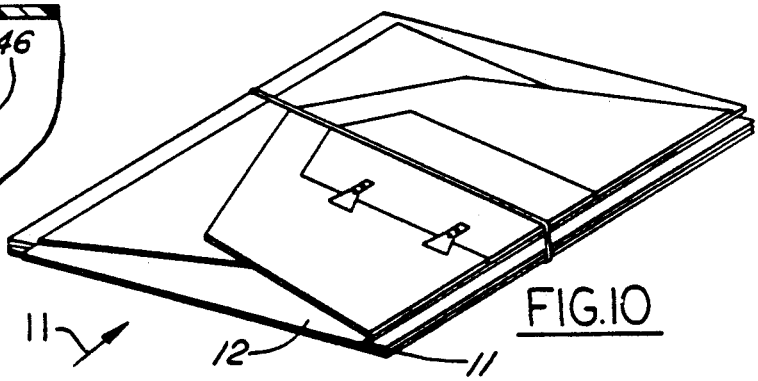
FIG. 10 is a perspective view of the two boards in a storage position.

FIGS. 10 and 11 show boards 11 and 12 with all of the necessary hardware attached and folded into a storage position. A strip 100 is used to prevent the portable utility structure 1 from unfolding until needed.

Figure 12:
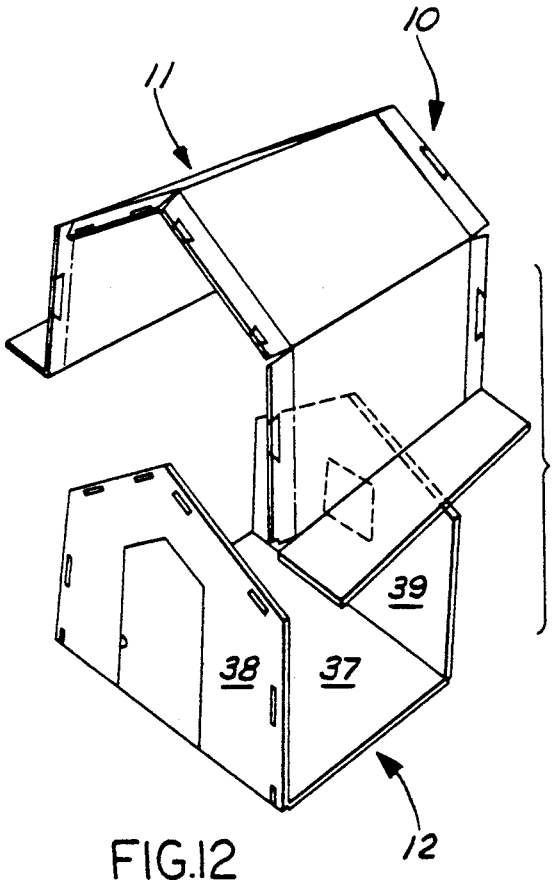
FIG. 12 is a perspective assembly view, showing the two boards being assembled.

Assembly of the portable utility structure is best shown in the perspective view of FIG. 12. Board 12 is placed on the ground with inner face 35 facing up. Front panel 38 and rear panel 39 are folded upwardly relative to bottom panel 37. At the same time, board 11 is folded such that it will fill the gap created between front panel 38 and rear panel 39, and so as to come into contact with portions of all three panels, to define an enclosed structure.

Figure 13:
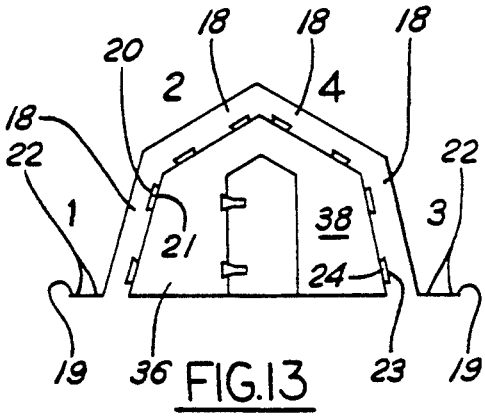
FIG. 13 is a front view of the present invention after final assembly.

Completed assembly of the portable utility structure 10 is shown in the front view of FIG. 13. Extension panels 18 are shown folded over and contacting outer face 36 of front panel 38. Tabs 20 and 23 are inserted in corresponding slots 21 and 24, respectively. Finally, sand flaps 19 are folded out such that they contact the ground, and a heavy material such as sand bags 22 are placed on top. The complete portable utility structure 10 is shown in FIG. 1.

In one embodiment, boards 11 and 12 were approximately 6.5 feet wide, 16 feet in length and 0.2 inches thick, resulting in an approximate weight of 41.6 lbs per portable utility structure 10 when made from extruded, corrugated polyethelene. The resulting floor space is 6 feet by 5.5 feet. Besides being light, polyethelene has a variety of other advantages. It is strong, resistant to ultra-violet radiation and doesn't distort in high temperatures. The resins which are used to make the polyethelene are non-toxic. Preferably, the polyethelene is corona treated, and has extrusion oils removed. Most preferably, polyethelene is available under the tradename Corx and available from Primex Plastics, Inc. is used. Preferably, a steel rule die is used for each board.

Several preferred embodiments of the present invention have been disclosed. A worker of ordinary skill in the art would realize, however, that certain modifications of this invention would be obvious from the teachings of this application. Thus, the following claims should be studied in order to determine the true scope and content of the invention.

I claim:

1. A portable utility structure comprising:

at least two sidewall panels and at least one roof panel defining an enclosed space, wherein said panels include interlocking means for detachably securing said panels with adjacent panels to selectively maintain said portable utility structure in an erect state; and one or more of said sidewall panels include an opening, said opening is a door, which may be selectively opened or closed relative to said one sidewall panel, one edge of said door being integrally hinged with respect to said sidewall panel, and another edge has a clasp designed to selectively engage said sidewall panel, said clasp consisting of two parallel generally planar surfaces connected by at least two members extending perpendicularly to said surfaces, said clasp being movable within a channel formed in said door, said channel having an inner and outer edge such that when one of said members of said clasp contacts said outer edge of said channel, said clasp engages said sidewall panel, while said clasp does not engage said sidewall panel when one of said members contacts said inner edges of said channel.

2. The portable utility structure recited in claim 1, wherein said sidewall panels and said roof panel are formed from two separate planar members.

3. The portable utility structure recited in claim 2, further comprising a bottom panel associated with said sidewall panels.

4. The portable utility structure recited in claim 1, wherein said interlocking means includes tabs associated with sides of said panels and adapted to pass through aligned apertures in an adjacent panel.

5. The portable utility structure recited in claim 1, wherein each said sidewall panel is five-sided, a first side being of a first dimension extending between two ends, a second side being of a second dimension extending between two ends with one of said ends corresponding to one of said ends of said first side, a third side being of a third dimension extending between two ends with one of said ends corresponding to the other of said ends of said second side, a fourth side being of a dimension approximately equal to said third dimension and extending between two ends with one of said ends corresponding to the other of said ends of said third side, and a fifth side being of a dimension approximately equal to said second dimension extending between two ends with one of said ends corresponding to the other one of said ends of said fourth side and the other of said ends of said fifth side corresponding to the other of said ends of said first side.

6. The portable utility structure recited in claim 5, wherein there are a plurality of roof panels including:

(a) two upper roof panels each having an inner and outer face, two longitudinally extending edges, with one edge being a lower longitudinal edge and the other an upper longitudinal edge, and two laterally extending edges; and (b) two lower roof panels, each lower roof panel comprising an inner and outer face, two longitudinally extending edges with one edge being a lower longitudinal edge and the other an upper longitudinal edge, and two laterally extending edges.

7. The portable utility structure recited in claim 6, wherein said lower longitudinal edge of each said upper roof panel is integrally hinged with an upper longitudinal edge of one of said lower roof panels.

8. The portable utility structure defined in claim 6, wherein fixing means are selectively used to secure said portable utility structure to the ground.

9. The portable utility structure defined in claim 8, wherein said fixing means and roof panels are constructed from a unitary blank of material, comprising serially:

a first flap, consisting of an inner and outer face, two longitudinally extending edges with one edge being a lower longitudinal edge and the other an upper longitudinal edge, and two laterally extending edges;

a first said lower roof panel, said lower longitudinal edge of said first lower roof panel being integrally hinged with said upper longitudinal edge of said first flap;

a first said upper roof panel, said lower longitudinal edge of said first upper roof panel being integrally hinged with said upper longitudinal edge of said first lower roof panel;

a second said upper roof panel, said upper longitudinal edge of said first upper roof panel being integrally hinged with said upper longitudinal edge of said second upper roof panel;

a second said lower roof panel, said upper longitudinal edge of said second lower roof panel being integrally hinged with said lower longitudinal edge of said second upper roof panel; and a second flap, consisting of an inner and outer face, two longitudinally extending edges with one edge being a lower longitudinal edge and the other an upper longitudinal edge, said upper longitudinal edge of said second flap being integrally hinged with said lower longitudinal edge of said second roof panel, such that when said portable utility structure is assembled, said inner faces of said flaps are in contact with the ground and a downward force may be applied to said upper face of said first and second flaps.

10. The portable utility structure recited in claim 9, wherein said roof panels each include extension panels integrally hinged with a lateral edge of each said roof panel, said tabs being associated with certain of said extension panels, wherein each extension panel is four-sided, comprising an inner and outer face with a first lateral side having a dimension approximately equal to said dimension of said edge of said roof panel, a second lateral side parallel to said first lateral side with a dimension equal to or less than said dimension of said first lateral side, and two additional sides with a directional component along a longitudinal axis perpendicular to said laterally extending edges.

11. The portable utility structure defined in claim 1, wherein one of said sidewall panels includes a window with an inner and outer face, which may be selectively opened and closed relative to said sidewall panel.

12. The portable utility structure defined in claim 11, wherein one edge of said window is integrally hinged with respect to said sidewall panel with motion limited such that said window can only break a plane defined by said outer face of said sidewall panel, and another edge has at least one clasp designed to selectively engage said sidewall panel.

13. The portable utility structure defined in claim 12, wherein said clasp is located on said inner face of said window and consists of a generally planar surface, connected to said window by one member extending along a longitudinal axis perpendicular to said inner face, such that when said planar surface is rotated about said longitudinal axis, said clasp will selectively engage said sidewall panel.

14. A portable utility structure comprising:

two sidewall panels, wherein each said sidewall panel is five-sided, a first side being of a first dimension extending between two ends, a second side being of a second dimension extending between two ends with one of said ends corresponding to one of said ends of said first side, a third side being of a third dimension extending between two ends with one of said ends corresponding to the other of said ends of said second side, a fourth side being of a dimension approximately equal to said third dimension extending between two ends with one of said ends corresponding to the other of said ends of said third side, and a fifth side being of a dimension approximately equal to said second dimension extending between two ends with one of said ends corresponding to the other of said ends of said fourth side and the other of said ends of said fifth side corresponding to the other of said ends of said first side;

two upper roof panels having an inner and outer face, two longitudinally extending edges of a fourth dimension, with one edge being a lower longitudinal edge and the other an upper longitudinal edge, and two laterally entending edges of a dimension approximately equal to said third dimension, two lower roof panels with each lower roof panel comprising an inner and outer face, two longitudinally extending edges being of a dimension approximately equal to said fourth dimension, with one edge being a lower longitudinal edge and the other an upper longitudinal edge, and two laterally extending edges being of a dimension approximately equal to said second dimension;

a first flap, consisting of an inner and outer face with a first and second side having two longitudinally extending edges with one edge being a lower longitudinal edge and the other an upper longitudinal edge, and two laterally extending edges;

a first said lower roof panel, said lower longitudinal edge of said first lower roof panel being integrally hinged with said upper longitudinal edge of said first flap:

a first said upper roof panel, said lower longitudinal edge of said first upper roof panel being integrally hinged with said upper longitudinal edge of said first lower roof panel;

a second said upper roof panel, said upper longitudinal edge of said first upper roof panel being integrally hinged with said upper longitudinal edge of said second upper roof panel;

a second said lower roof panel, said upper longitudinal edge of said second lower roof panel being integrally hinged with said lower longitudinal edge of said second upper roof panel;

a second flap, consisting of an inner and outer face, two longitudinally extending edges with one edge being a lower longitudinal edge and the other an upper longitudinal edge, said upper longitudinal edge of said second flap being integrally hinged with said lower longitudinal edge of said second roof panel, such that when said portable utility structure is in assembled, said inner faces of said flaps are in contact with the ground and a downward force may be applied to said upper face of said first and second flaps; and interlocking means for detachably securing certain of said panels with adjacent panels to selectively maintain said portable utility structure in said erect state, said interlocking means including tabs associated with certain sides of a panel and adapted to pass through aligned apertures in said adjacent panels, said tabs being found at laterally outer edges of said panels, said laterally outer edges have tabs, and non-tab portions, said tabs extending though said openings, and said non-tab portions remaining outside said openings.

15. The portable utility structure recited in claim 14, further comprising a bottom panel with an outer and inner face, two longitudinally extending edges of a dimension approximately equal to said fourth dimension, and two laterally extending edges of a dimension equal to or greater than said first dimension.

16. The portable utility structure defined in claim 15, wherein each of said sidewall panels is integrally hinged to one of said lateral edges of said bottom panel.

17. A portable utility structure comprising:

at least two sidewall panels and at least one roof panel defining an enclosed space, wherein said panels include interlocking means for detachably securing said panels with adjacent panels to selectively maintain said portable utility structure in an erect state, said interlocking means including tabs associated with certain sides of said panel and adapted to pass through openings in said adjacent panels, said tabs being formed at laterally outer edges of said panels, said laterally outer edges having tabs, and non-tab portions, said tabs extending through said openings and said non-tab portions remaining outside said openings.

* * * * *